US006340032B1

(12) United States Patent
Zosimadis

(10) Patent No.: US 6,340,032 B1
(45) Date of Patent: Jan. 22, 2002

(54) FAUCET AND SYSTEM FOR USE WITH A FAUCET

(76) Inventor: Peter Zosimadis, 41 Asterwind Crescent, Brampton, Ontario (CA), L6R 1V8

( * ) Notice: Subject to any disclaimer, the term of this patent is extended or adjusted under 35 U.S.C. 154(b) by 0 days.

(21) Appl. No.: 09/637,239

(22) Filed: Aug. 14, 2000

(51) Int. Cl.[7] ..... F16K 31/02

(52) U.S. Cl. ..... 137/552; 137/554; 137/801; 4/623; 4/678

(58) Field of Search ..... 137/801, 552, 137/554; 4/678, 623

(56) References Cited

U.S. PATENT DOCUMENTS 4,756,030 A * 7/1988 Juliver ..... 4/668
5,095,941 A * 3/1992 Betz ..... 137/552
5,170,944 A * 12/1992 Shirai ..... 239/569
5,184,642 A * 2/1993 Powell ..... 251/129.04
5,441,070 A * 8/1995 Thompson ..... 137/1
5,458,147 A * 10/1995 Mauerhofer ..... 137/1
5,521,840 A * 5/1996 Bednar ..... 702/183
5,961,095 A * 10/1999 Schrott ..... 251/129.04

* cited by examiner

*Primary Examiner*—A. Michael Chambers
(74) *Attorney, Agent, or Firm*—Bereskin & Parr

(57) ABSTRACT

The present invention relates to faucets of the type used in sinks, lavatories, urinals and the like. Typically these faucets are made from metal or plated plastics and are electrically conductive. A module affixed to the outlet end of the faucet senses temperature or other fluid properties and generates a signal. A valve controller receives the generated signal and positions a control valve accordingly. The generated signal is communicated from the module to the valve controller by passing the signal along the conduit itself.

35 Claims, 18 Drawing Sheets

FAUCET AND SYSTEM FOR USE WITH A FAUCET

FIELD OF THE INVENTION

The present invention relates to faucets and retrofit systems for faucets, and more particularly to faucet and retrofit systems that monitor and control fluid properties of dispensed fluids.

BACKGROUND OF THE INVENTION

There are several faucets and retrofit systems available that monitor fluid temperature of fluid flowing out of the faucet, and that provide some level of control over the flow of fluid out of the faucet, based on the temperature monitored.

Systems include those described in Canadian Patent Application 2,162,802 (Zosimadis) and in U.S. Pat. No. 5,184,642 (Powell).

Such systems use sensors to measure fluid temperature, a valve controller and valve, where the valve controller actuates the valve based on the temperature of the fluid, and a means for sending information from the sensors to the valve controller. Because the sensors for the fluid properties are sometimes located remotely from the valve and valve controller, a transmitter is usually located at the sensors, and a receiver is usually located at the valve controller.

The transmitters and receivers disclosed in the prior art communicate with each other, either along wires that extend between them, or by radio frequencies or other 'through-the-air' means, usually referred to as wireless systems.

Although these systems are effective in monitoring fluid temperature, they have drawbacks that hamper their marketability. For example, the systems that use a wired connection on the faucet may be viewed as a high risk for electrocution by consumers. Alternately, wireless systems that communicate by radio frequency or the like, can be bulky, unattractive and expensive to manufacture.

Consequently, there is a need for a system to provide fluid monitoring and flow control, which is aesthetically pleasing and economical.

SUMMARY OF THE INVENTION

The present invention relates to a faucet including an electrically conductive fluid outlet conduit, an electrical transmitter that is connected electrically with the outlet conduit, one or more valves for controlling the flow of fluid through the outlet conduit, a valve controller for changing the position of the valve(s), the valve controller including a receiver that is connected electrically with the outlet conduit, the valve controller being adapted for receiving electrical signals from the transmitter, and wherein the electrical signals are communicated from the transmitter to the receiver through the outlet conduit.

In another aspect of the invention, the invention involves a kit of parts for retrofit to an existing faucet with an electrically conductive fluid outlet conduit. The kit of parts comprises an adaptor, which comprises at least one sensor and a transmitter, which is to be connected electrically with the outlet conduit, the transmitter being adapted to transmit electrical signals through the outlet conduit, at least one control valve for controlling the flow of fluid through the outlet conduit, and a valve controller for changing the position of the control valve, the valve controller further comprising an electrical signal receiver for receiving electrical signals through the outlet conduit, the electrical signal receiver connected electrically with the outlet conduit.

DESCRIPTION OF THE DRAWINGS

A more complete understanding of the invention may now be appreciated from reviewing the following descriptions of preferred embodiments of the invention, and in which.

DESCRIPTION OF THE PREFERRED EMBODIMENT

Figure 1:
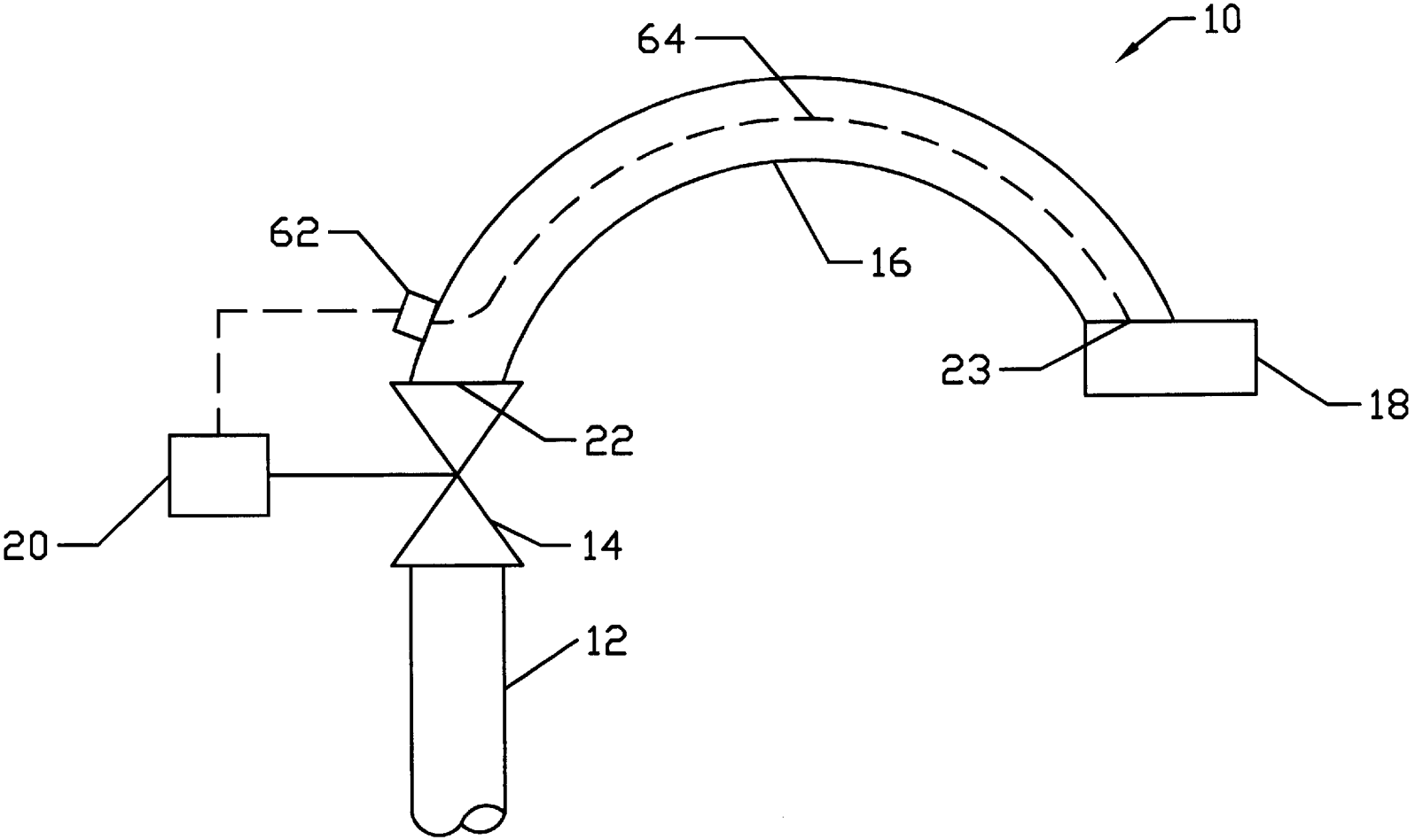
FIG. 1—is a schematic view of a faucet in accordance with a preferred embodiment of the present invention.

A simple, preferred embodiment of the present invention is shown in FIG. 1. A faucet 10 comprises a fluid supply conduit 12, a control valve 14, a fluid outlet conduit 16, an adaptor 18 and a valve controller 20. Faucet 10 is defined for the purposes in this disclosure and claims to include but is not limited to: a kitchen faucet, a lavatory faucet, a bar faucet, a utility faucet, a shower faucet, a tub faucet, a roman faucet, a washbasin, a urinal, and a toilet.

Faucet 10 carries fluid from a fluid supply (not shown), and discharges the fluid. The fluid path through faucet 10 is from fluid supply (not shown), through supply conduit 12, through control valve 14, through outlet conduit 16, through adaptor 18, and out.

Control valve 14 controls the flow of fluid from supply conduit 12 into outlet conduit 16 and may be any valve known in the art that is electrically operated and can seal against liquid flow. Outlet conduit 16 is made from an electrically conductive material, such as an electrically conductive metal or polymer. For example, the outlet conduit 16 may be made from brass, copper, stainless steel, alloy steel, or chrome plated plastic. Outlet conduit 16 has an inlet end 22 and an outlet end 23. At the outlet end 23 of outlet conduit 16 is mounted adaptor 18, and at the inlet end 22 is mounted control valve 14 with valve controller 20.

Figure 2:
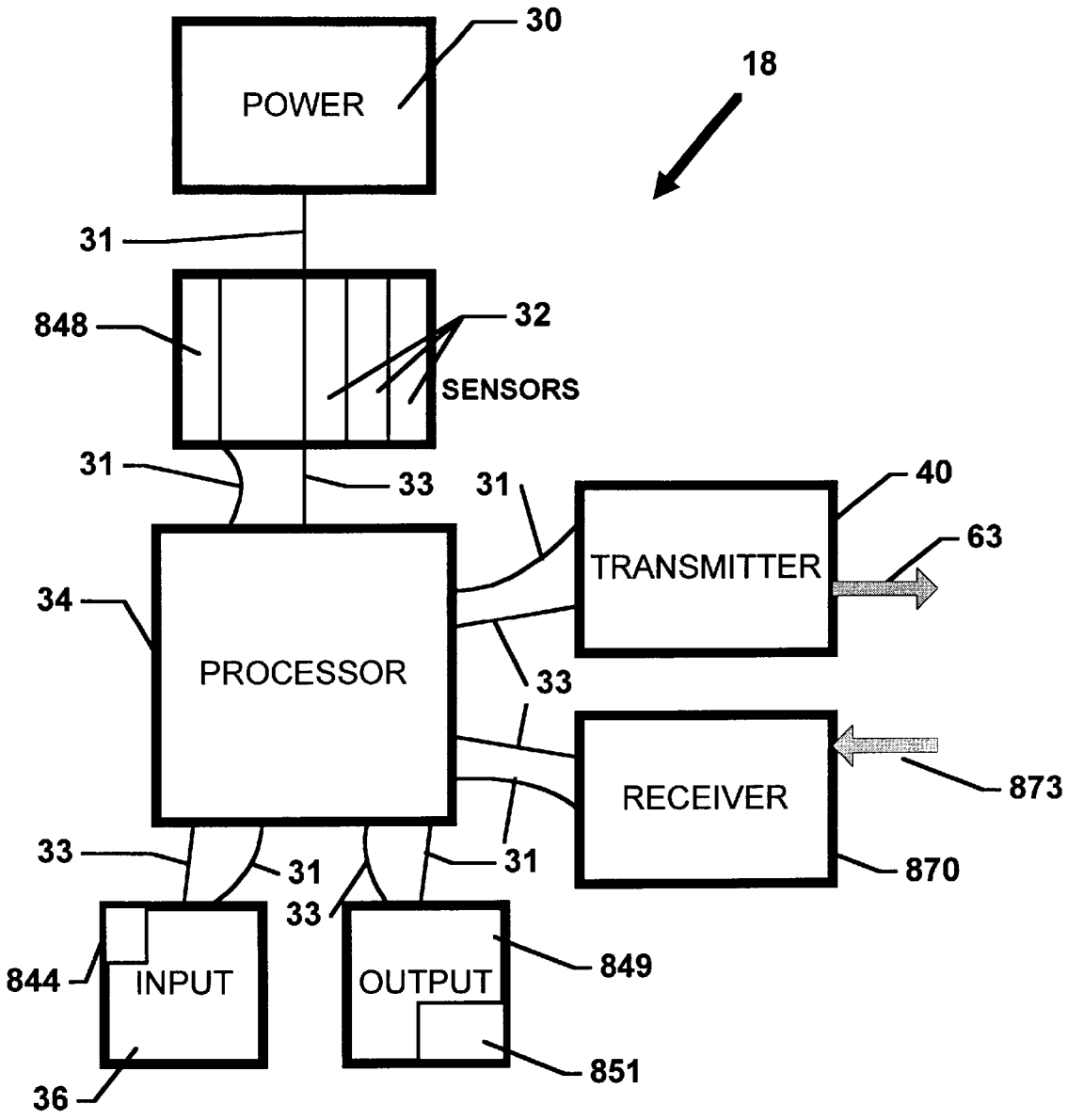
FIG. 2—is a block diagram of an adaptor for use with the faucet shown in FIG. 1.

As shown in FIG. 2, adaptor 18 includes an adaptor power module 30, a plurality of power connectors 31, at least one sensor 32 for sensing fluid properties, a plurality of signal connectors 33, an adaptor processor 34, an adaptor input module 36, and an adaptor transmitter 40. In this embodiment, outlet end 23 of outlet conduit 16 is threaded and adaptor 18 is threaded with a matching thread, and adaptor 18 is threaded onto the outlet end 23 of outlet conduit 16, thereby physically and electrically connecting outlet conduit 16 and adaptor 18. However, adaptor 18 may be mounted in any way such that transmitter 40 is in electrical communication with outlet conduit 16 and such that sensors 32 are located to sense the desired fluid properties.

Sensors 32 detect fluid properties such as PH, temperature, conductivity, clarity, and levels of chlorine, bacteria, pesticide, cysts, protozoa, fecal matter, lead, silt, rust, asbestos or other sediments, calcium, ammonia, nitrites, and nitrates. Any other fluid properties known in the art may be sensed as well. If only one fluid property is to be sensed only one sensor would be required. If a plurality of properties are to be sensed then a plurality of sensors may be employed. Sensors 32 communicate fluid property data to adaptor processor module 34 through signal connectors 33. Signals sent between individual components of adaptor 18 are sent through a plurality of signal connectors 33.

Adaptor input module 36 is used to enable a user to input desired parameters to adaptor 18, including maximum and minimum acceptable fluid property values (safety limits), such as maximum and minimum fluid temperatures. As well, adaptor input module 36 may provide means for a user to initiate fluid flow, and to set the desired volume flow of fluid from faucet 10. Processor module 34 processes fluid property data received from sensors 32 to determine if any detected properties exceed specified safety limits. Based on the inputted parameters and the detected fluid properties, adaptor processor 34 sends signals 63 to valve controller 20 through adaptor transmitter 40. In this embodiment, signals 63 correspond to valve position (i.e. "Open Valve" and "Close Valve") commands. Power module 30 provides power to all required components in adaptor 18, through power connectors 31. Power module 30 preferably comprises a battery, but may be any other self-contained power source known in the art. Signal connectors 33 and power connectors 31 may be joined together in a single connector. Power, in this embodiment, is transferred in a combination of serial and parallel routes to the required components of adaptor 18, however, the power may be transferred by any means known in the art.

Adaptor 18 may further include a user-override switch 844 in input module 36, a user-detector sensor 848, an output module 849 that may include an alarm 851, and an electrical signal receiver 870 for.receiving signals 873. All of these items will be discussed further below.

Figure 3:
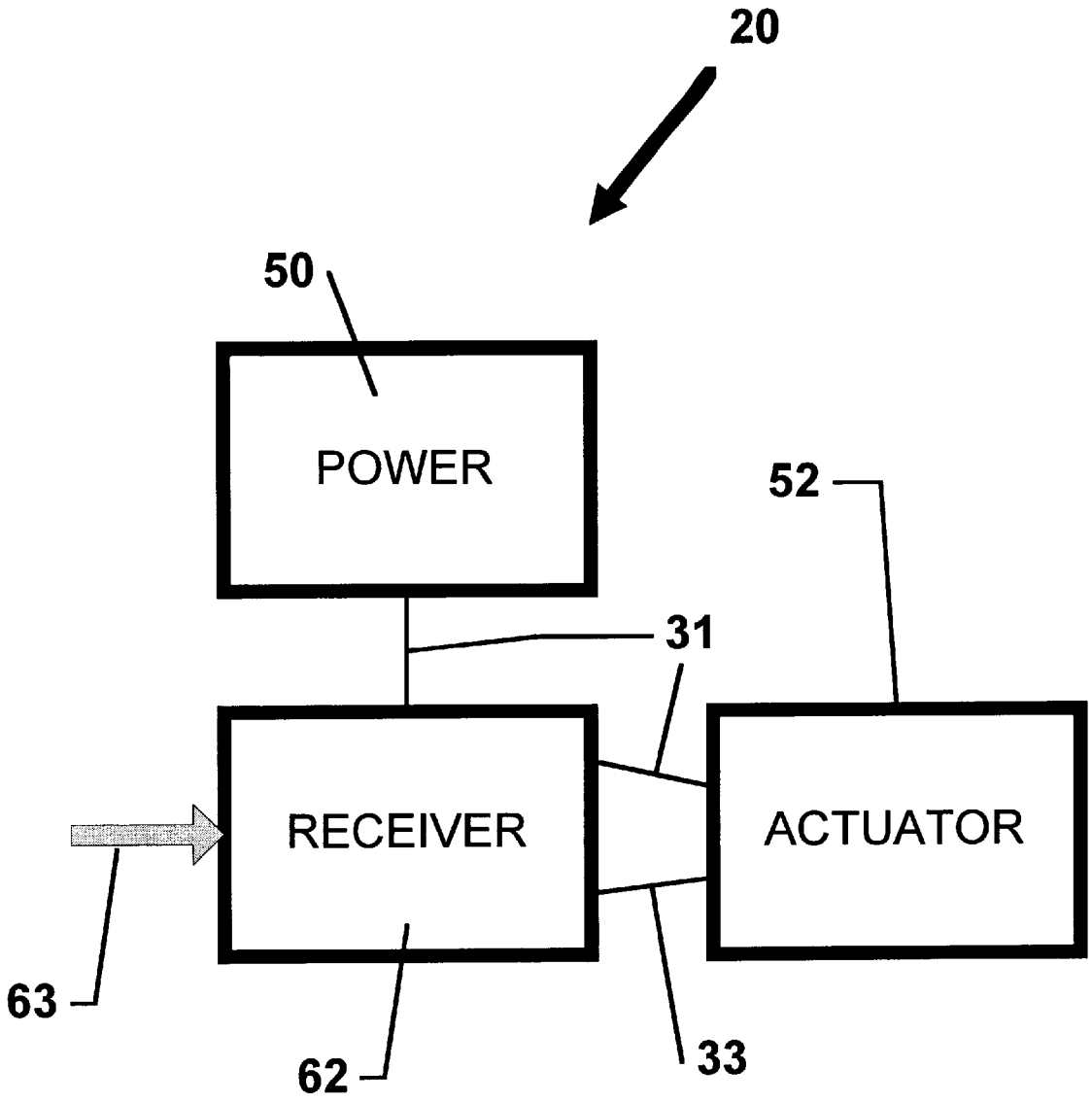
FIG. 3—is a block diagram of a valve controller for use with the faucet shown in FIG. 1.

Valve controller 20, shown in FIG. 3, actuates control valve 14 based on the signals 63 received from adaptor 18. Valve controller 20 includes a valve controller power module 50, a valve actuator 52, which actuates valve 14, a valve controller receiver 62, a plurality of power connectors 31, and a plurality of signal connectors 33. Power module 50 provides power to all required components of valve controller 20 through power connectors 31. Power module 50 is itself preferably a connection to a DC power source, such as a battery, but may alternately comprise a connection to an AC power source or any other power source known in the art. Power, in this embodiment, is transferred in a combination of serial and parallel routes to the required components, however it may be transferred by any means known in the art.

Valve controller receiver 62 receives signals 63 from adapter 18 and passes the signals 63 on to valve controller actuator 52. In the embodiment shown in FIG. 1, receiver 62 is attached to outlet conduit 16, by means of welds. Receiver 62 may, however, be located in any way such that it is in electrical communication with outlet conduit 16. For example, receiver 62 may be bolted to outlet conduit 16. Alternately, if control valve 14 is made from a conductive material and is in electrical communication with outlet conduit 16, then receiver 62 may be mounted on control valve 14, such that receiver 62 and control valve 14 are in electrical communication with each other. Signals sent between individual components of valve controller 20 are sent through signal connectors 33. Signal connectors 33 and power connectors 31 may be joined together in a single connector.

In this embodiment, adaptor 18 and valve controller 20 operate such that, in the event that adaptor 18 determines that a detected fluid property exceeds a specified limit, adaptor transmitter 40 sends a signal 63 to valve controller receiver 62, indicating for valve controller 20 to close control valve 14. Signals 63 sent between transmitter 40 and receiver 62 are sent through electrically conductive outlet conduit 16.

The electrical signal path 64, through which signals 63 are sent between adaptor 18 and valve controller receiver 62, is schematically illustrated in FIG. 1. The electrical signal path does not use wires and is not wireless as that term is conventionally used. Rather, the signal path 64 is through the electrically conductive fluid outlet conduit to which the adaptor 18 and the controller 20 are electrically connected. The signals sent may correspond to the following: "Open control valve 14", "Close control valve 14", and one or more fluid properties. The sending of fluid property data signals will be discussed further below.

Figure 4:
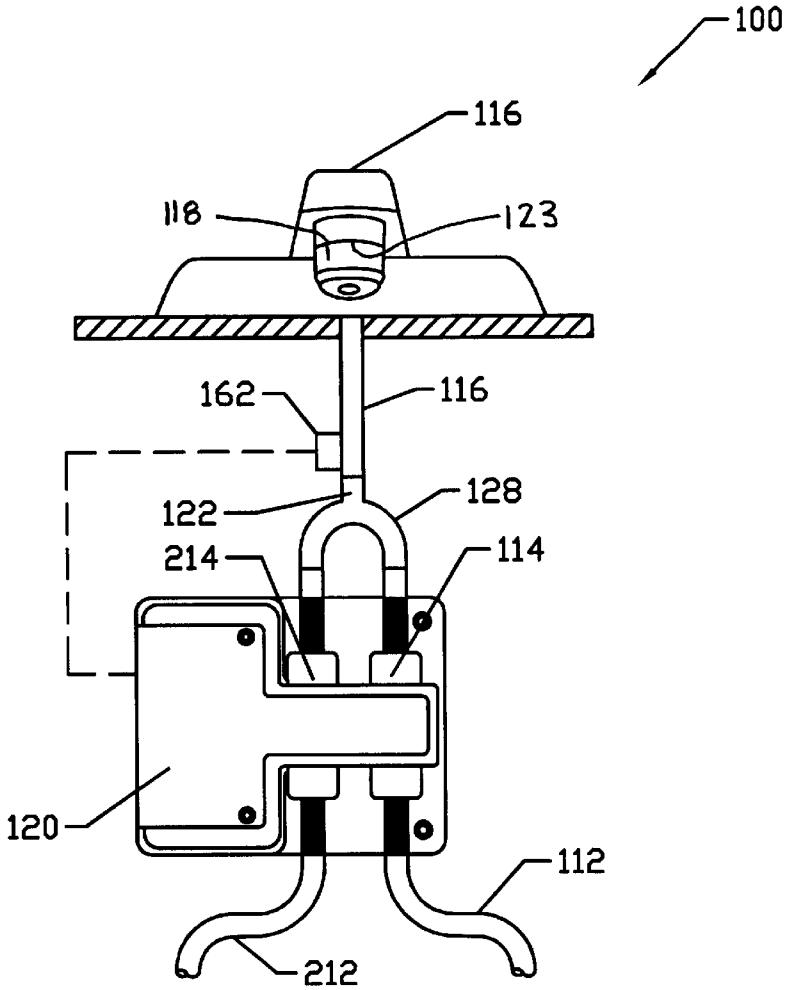
FIG. 4—is a front elevation view of a double-valve faucet in accordance with another preferred embodiment of the present invention.
Figure 4A:
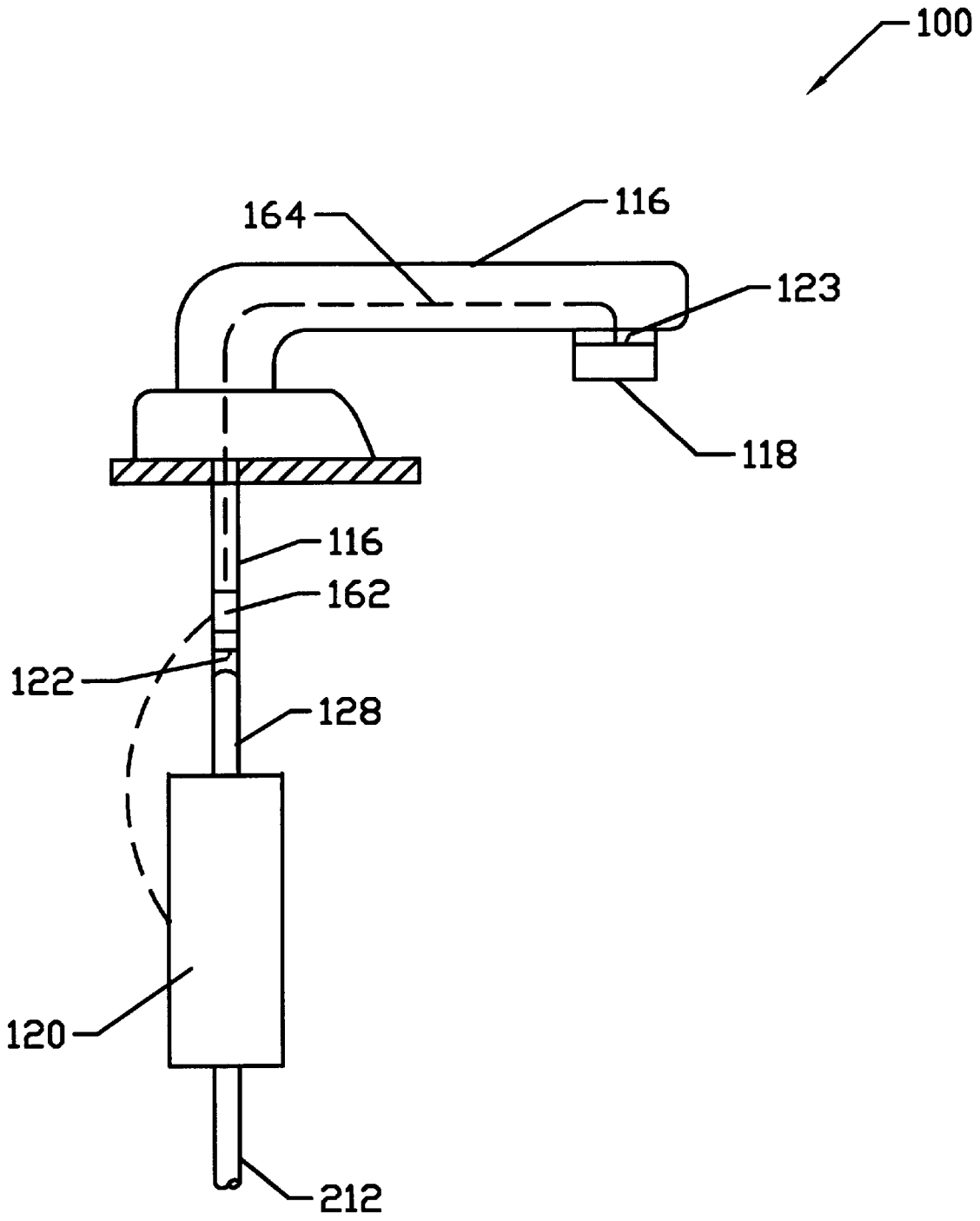
FIG. 4*a*—is a side elevation view of the faucet shown in FIG. 4.

FIGS. 4, 4*a*, 5 and 6 show an alternate embodiment of the present invention. Referring to FIGS. 4 and 4*a*, faucet 100 includes a first fluid supply conduit 112, a second fluid supply conduit 212, a first fluid control valve 114, a second fluid control valve 214, a valve controller 120, a tee 128, an outlet conduit 116, and an adaptor 118. Supply conduits 112 and 212 carry to faucet 100, first and second fluids respectively, from first and second fluid supplies respectively (not shown). Control valves 114 and 214 are similar to control valve 14 except that they are designed such that they may be opened fully, closed fully, or opened partially, thus allowing a range of partial flows of fluid through them. Control valves 114 and 214 connect to supply conduits 112 and 212 respectively. Tee 128 connects at its two inlets to control valves 114 and 214 and at its outlet, to inlet end 122 of outlet conduit 116, as shown.

Similar to the embodiment in FIG. 1, in this embodiment the outlet end 123 of outlet conduit 116 is threaded and adaptor 118 is threaded with a matching thread, and adaptor 118 is threaded onto the outlet end 123 of outlet conduit 116, thereby connecting outlet conduit 116 with adaptor 118. However, adaptor 118 may be mounted in any way such that transmitter 140 is in electrical communication with outlet conduit 116 and such that sensors 132 are located to sense the desired fluid properties.

Figure 5:
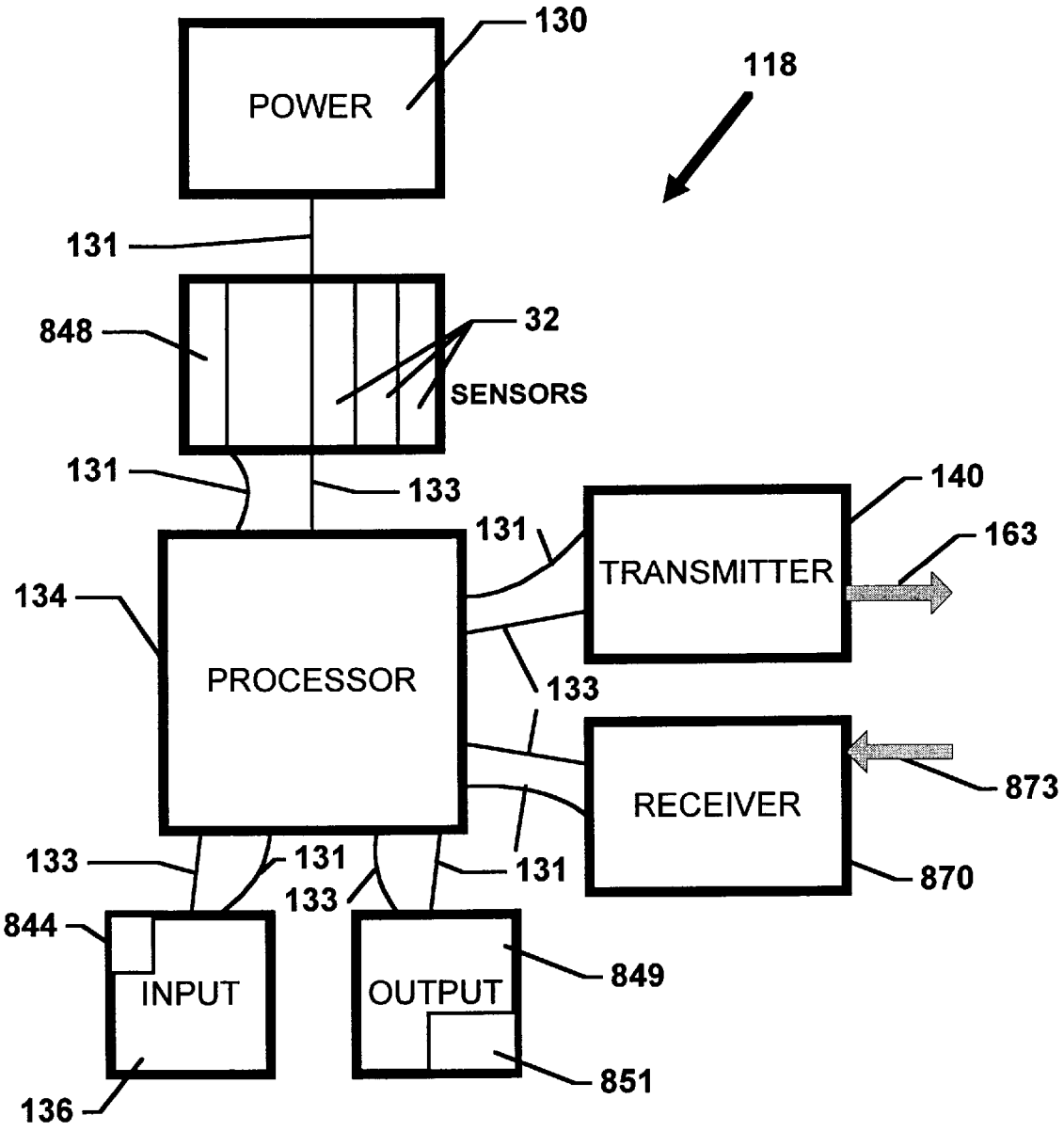
FIG. 5—is a block diagram of an adaptor for use with the faucet shown in FIG. 4.

Referring now to FIG. 5, adaptor 118 is similar to adaptor 18 with the following differences. Adaptor 118 includes an adaptor processor 134 instead of adaptor processor 34. Adaptor processor 134 is adapted to send valve command signals 163 to operate two valves. Adaptor input module 136 is similar to adaptor input module 36 but is further adapted to receive a target value for any fluid property that differs between the two fluids. For example, if the two fluids are hot and cold water, the fluid property that differs between them is temperature, and the target value that can be entered into input module 136 will therefore be a specified temperature of the dispensed water.

Figure 6:
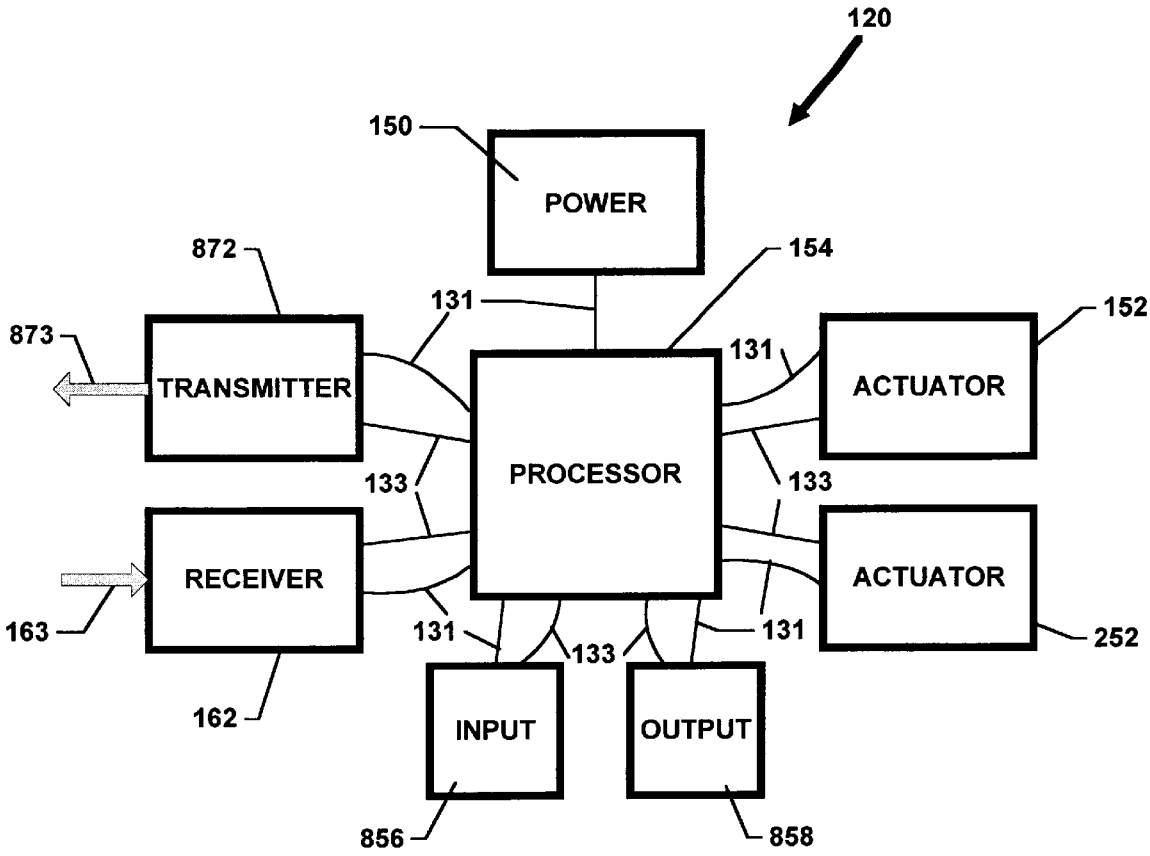
FIG. 6—is a block diagram of a valve controller for use with the faucet shown in FIG. 4.

Referring now to FIG. 6, valve controller 120 includes a power module 150, a plurality of power connectors 131, a plurality of signal connectors 133, valve actuators 152 and 252 for actuating control valves 114 and 214 respectively, a processor module 154 for processing received signals 163 and for sending valve actuation signals to valve actuators 152 and 252, and a valve controller receiver 162 for receiving signals 163 from adaptor 118.

Valve controller 120 can position control valves 114 and 214 independently, into fully open or closed, or partially open states, thus allowing only a first fluid to flow, or only a second fluid to flow, or allowing a desired mixture ratio of the two fluids to flow. Power module 150 powers all required components of valve controller 120, through power connectors 131. Signals sent between individual components of valve controller 120 are sent through signal connectors 133. Signal connectors 133 and power connectors 131 may be joined together in a single connector.

Valve controller 120 may further comprise an input module 856, an output module 858, and a valve controller transmitter 872 for transmitting electrical signals 873. All of these items will be discussed below.

If the desired fluid property, as sensed by adaptor 118, strays from the specified target value, the position of one or both of control valves 114 and 214 is adjusted in order to adjust the ratio of the first fluid and the second fluid, in order to maintain the fluid property value at or substantially at its target value. Preferably, in the event that the sensed fluid property strays by more than a specified 'adjustment-causing' amount, then the valve controller will adjust both control valves 114 and 214, increasing the flow through one valve and decreasing the flow through the other valve each by a predetermined amount, so as to maintain roughly the same fluid flow rate through outlet conduit 116. If any fluid property, however, exceeds specified safety limits, valve controller 120 will close control valves 114 and 214.

An electrical signal path 164, through which signals 163 are sent between adaptor 118 and valve controller receiver 162, is schematically illustrated in FIG. 4*a*. The signal path 164 is through the outlet conduit 116 to which the adaptor 118 and the controller receiver 162 are electrically connected.

The signals sent may correspond to the following valve commands: "Open both control valves", "Close both control valves", "Increase flow in one control valve and decrease flow in the other control valve by a predetermined amount" or one or more fluid properties. Due to the increased complexity in the nature of the signals sent between the adaptor and the receiver, relative to the simple embodiment described above, both the adaptor processor and the valve controller processor will require additional means for ensuring that the signals are intelligible at the receiver. This will be discussed further below.

Figure 8:
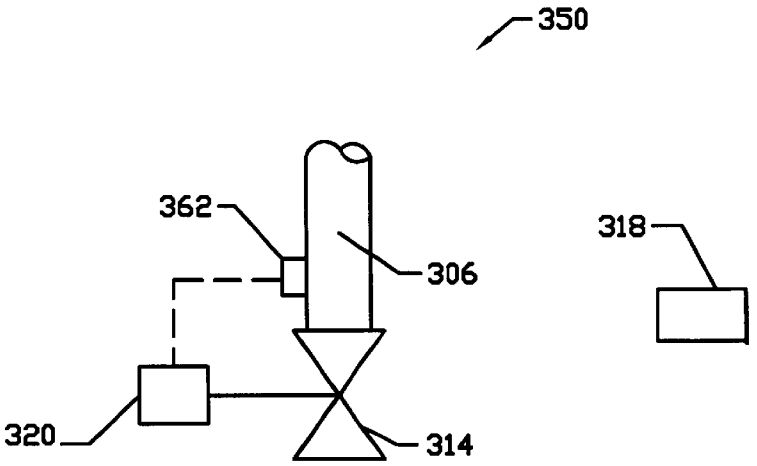
FIG. 8—is a schematic view of a kit of parts in accordance with another preferred embodiment of the present invention, for retrofit to an existing single-valve faucet.
Figure 7:
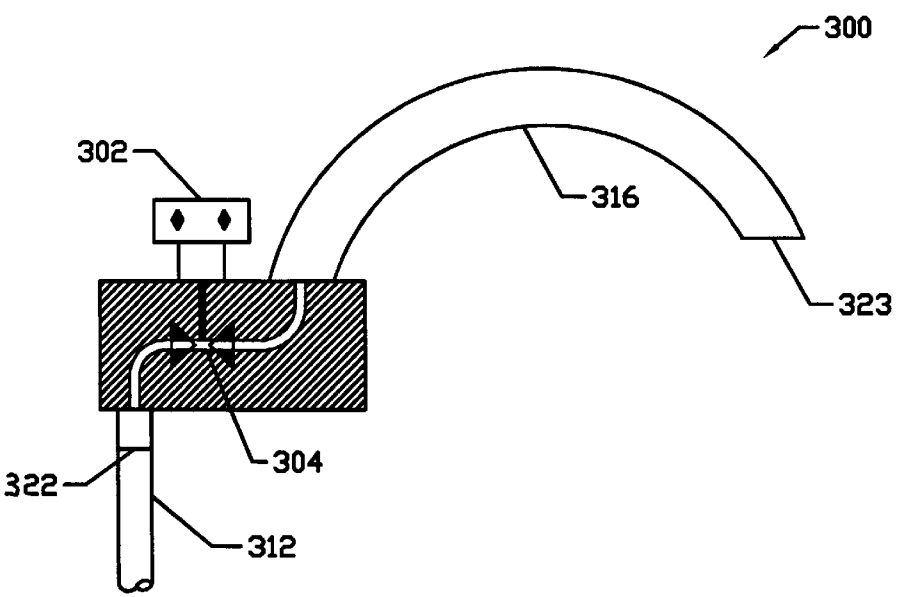
FIG. 7—is a schematic view of a single-valve faucet which can be adapted in accordance with embodiments in accordance with the present invention.
Figure 9:
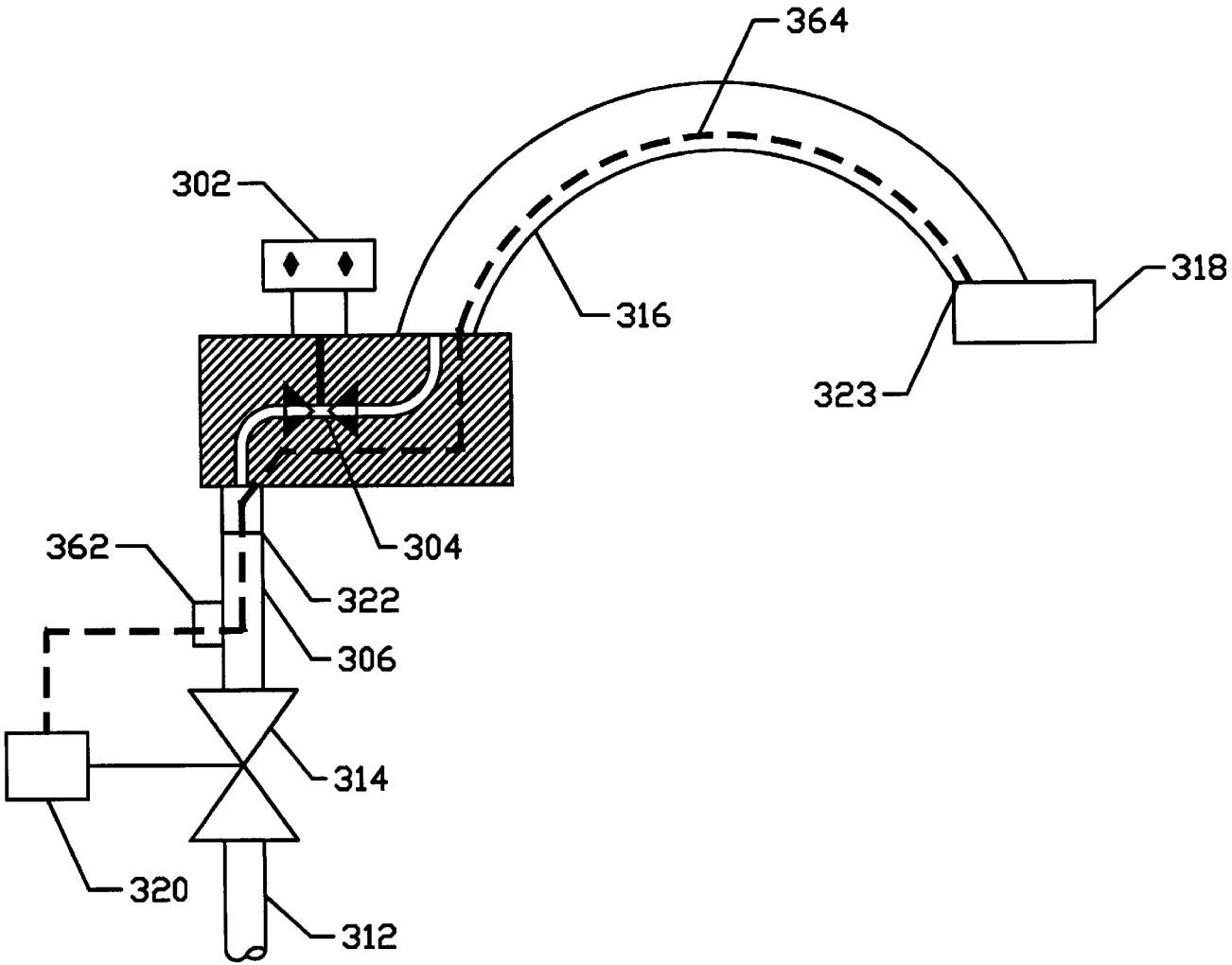
FIG. 9—is a schematic view of the single-valve faucet with the kit of parts of FIG. 8.

Another alternate embodiment of the present invention, as shown in FIGS. 8 and 9, is a kit of parts 350 for retrofit onto an existing single-valve faucet 300, shown in FIG. 7. Faucet 300 includes a supply conduit 312, that carries fluid to an outlet conduit 316. Outlet conduit 316 includes a hand valve 304. Outlet conduit 316 has an inlet end 322, which is upstream of hand valve 304 and which is connected to supply conduit 312. Outlet conduit 316 also has an outlet end 323, which is usually threaded. Hand valve 304 includes a hand actuator 302, which may be a hand knob, a mechanical push button or any other actuation means known in the art. Outlet conduit 316 must comprise at least enough conductive material such that an electrically conductive path exists between inlet end 322 and outlet end 323. Supply conduit 312 joins outlet conduit 316 at inlet end 322.

As shown in FIG. 8, the kit of parts 350 includes a valve conduit 306, control valve 314, an adaptor 318, and valve controller 320. Valve conduit 306 mounts to inlet end 322 of outlet conduit 316, and is manufactured from a conductive material, such as brass, copper, stainless steel, alloy steel, or chrome plated plastic. Attached to the upstream end of valve conduit 306 is control valve 314.

Adaptor 318 is similar to adaptor 18 except that adaptor 318 is adapted for mounting to outlet end 323 of existing outlet conduit 316. Similar to the embodiments described above, the outlet end 323 of outlet conduit 316 may be threaded and adaptor 318 may be threaded with a matching thread, and adaptor 118 is threaded onto the outlet end 323 of outlet conduit 316, thereby connecting outlet conduit 316 with adaptor 318. However, adaptor 318 may be mounted in any way such that a transmitter similar to transmitter 40, is in electrical communication with outlet conduit 316 and such that sensors similar to sensors 32, are located to sense the desired fluid properties. Valve controller receiver 362 may be mounted on conduit 306 as shown, or alternately may be mounted in any way such that it is in electrical communication with outlet conduit 316.

FIG. 9 shows the kit of parts 350 installed on faucet 300. An electrical signal path 364, through which signals 363 (not shown) can be sent between adaptor 318 and valve controller receiver 362, is shown schematically in FIG. 9.

Figure 10:
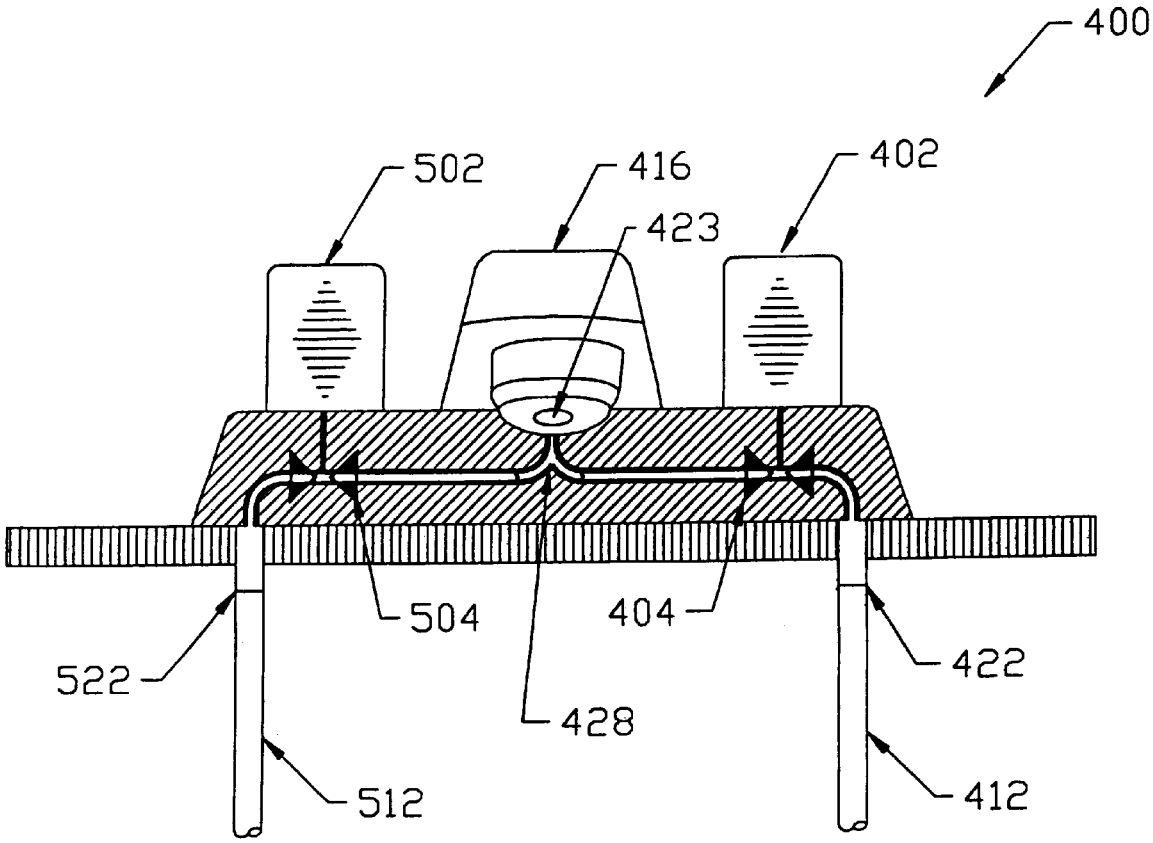
FIG. 10—is a front elevation view of a double-valve faucet which can be adapted in accordance with embodiments in accordance with the present invention.
Figure 11:
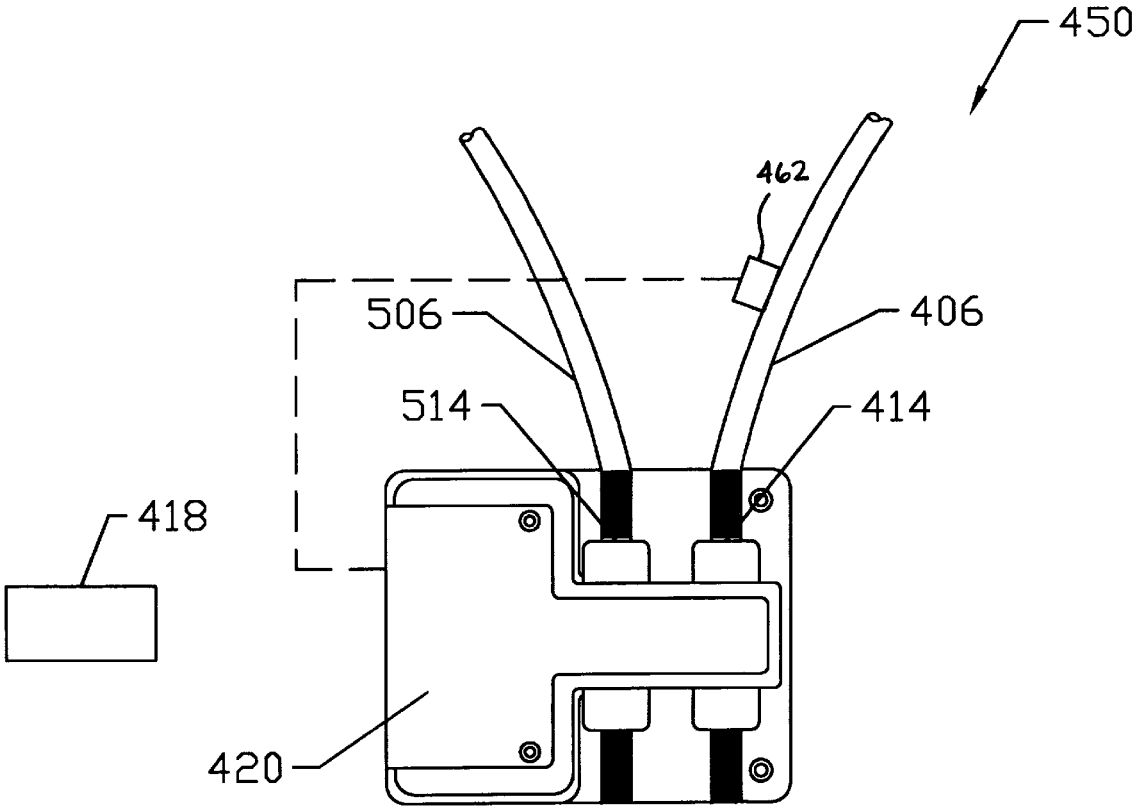
FIG. 11—is a front elevation view of a kit of parts in accordance with another preferred embodiment of the present invention, for retrofit to an existing double-valve faucet.
Figure 12:
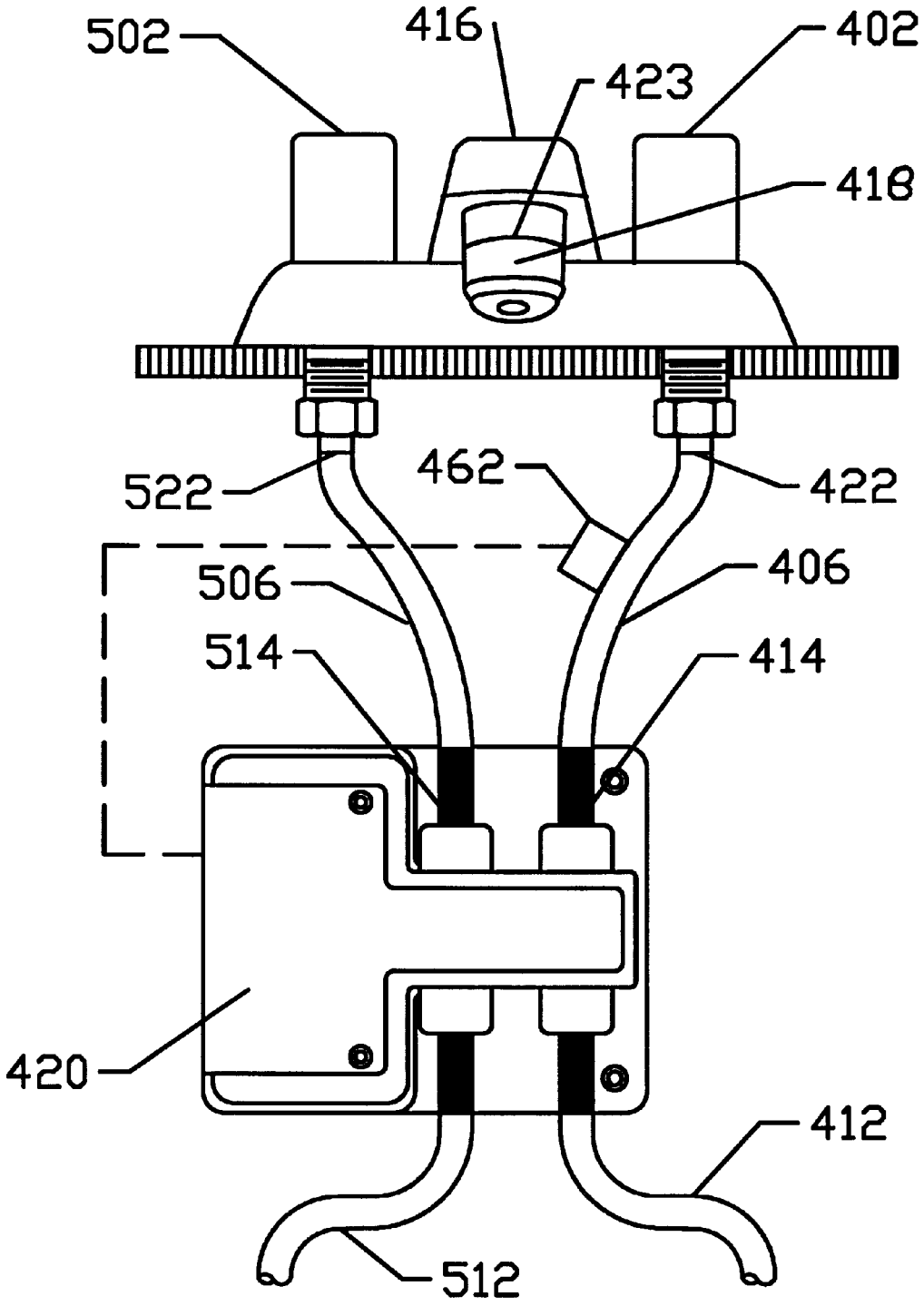
FIG. 12—is a front elevation view of a double-valve faucet with the kit of parts of FIG. 11.
Figure 12A:
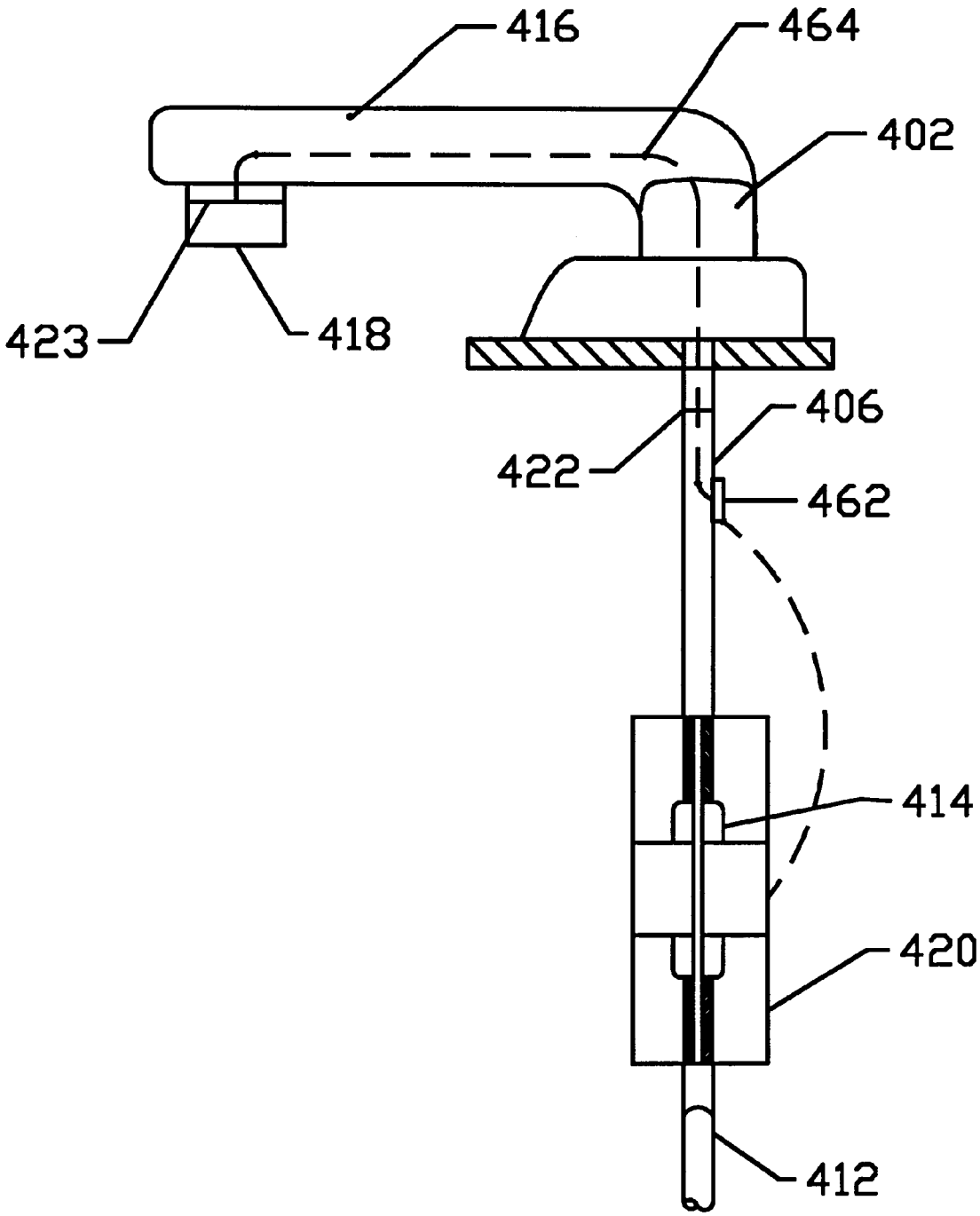
FIG. 12*a*—is a side elevation view of the faucet shown in FIG. 12.

Another alternate embodiment of the present invention, as shown in FIGS. 11, 12 and 12*a*, is a kit of parts 450 for retrofit to a double-valve faucet 400 shown in FIG. 10. Faucet 400 includes an outlet conduit 416, a first supply conduit 412, and a second supply conduit 512. Outlet conduit 416 includes an internal tee 428 for receiving fluid from two sources, and hand valves 404 and 504 which connect to the upstream ends of internal tee 428. Outlet conduit 416 has two inlet ends 422 and 522 which are upstream of valves 404 and 504 respectively, and an outlet end 423 that is usually threaded. Hand valves 404 and 504 include hand actuators 402 and 502. Hand actuators 402 and 502 may be hand knobs, mechanical push buttons or any other actuation means known in the art. Outlet conduit 416 must comprise at least enough conductive material such that an electrically conductive path exists between outlet end 423, and at least one of inlet ends 422 and 522. Supply conduits 412 and 512 carry to faucet 400, first and second fluids respectively, from first and second fluid supplies respectively (not shown). Supply conduits 412 and 512 connect to inlet ends 422 and 522 respectively, of outlet conduit 416.

As shown in FIG. 11, kit of parts 450 includes valve conduits 406 and 506, control valves 414 and 514, an adaptor 418, and valve controller 420. FIGS. 12 and 12*a* show the kit of parts 450 installed on faucet 400. Valve conduits 406 and 506 mount to the inlet ends 422 and 522 of outlet conduit 416, and are manufactured from a conductive material, such as, brass, copper, stainless steel, alloy steel, or chrome plated plastic. At least one of valve conduits 406 and 506 must be connected such that it is in electrical communication with outlet end 423 of outlet conduit 416. Attached to the upstream ends of valve conduits 406 and 506 are control valves 414 and 514, which are similar to control valves 114 and 214.

Adaptor 418 is similar to adaptor 118, except that adaptor 418 is adapted for fitting onto the outlet end 423 of outlet conduit 416. Similar to the embodiments described above, the outlet end 423 of outlet conduit 416 may be threaded and adaptor 418 may be threaded with a matching thread, and adaptor 418 is threaded onto the outlet end 423 of outlet conduit 416, thereby connecting outlet conduit 416 with adaptor 418. However, adaptor 418 may be mounted in any way such that an adaptor transmitter similar to transmitter 40 is in electrical communication with outlet conduit 416 and such that sensors similar to sensors 32 are located to sense the desired fluid properties. A valve controller receiver 462 is included in kit of parts 450, and may be mounted directly to one of valve conduits 406 and 506, such that receiver 462 is in electrical communication with outlet conduit 416. Receiver 462 may, however, be located in any way such that it is in electrical communication with outlet conduit 416.

An electrical signal path 464, through which signals 463 (not shown) can be sent between adaptor 418 and valve controller receiver 462, is shown schematically in FIG. 12*a*.

Figure 13:
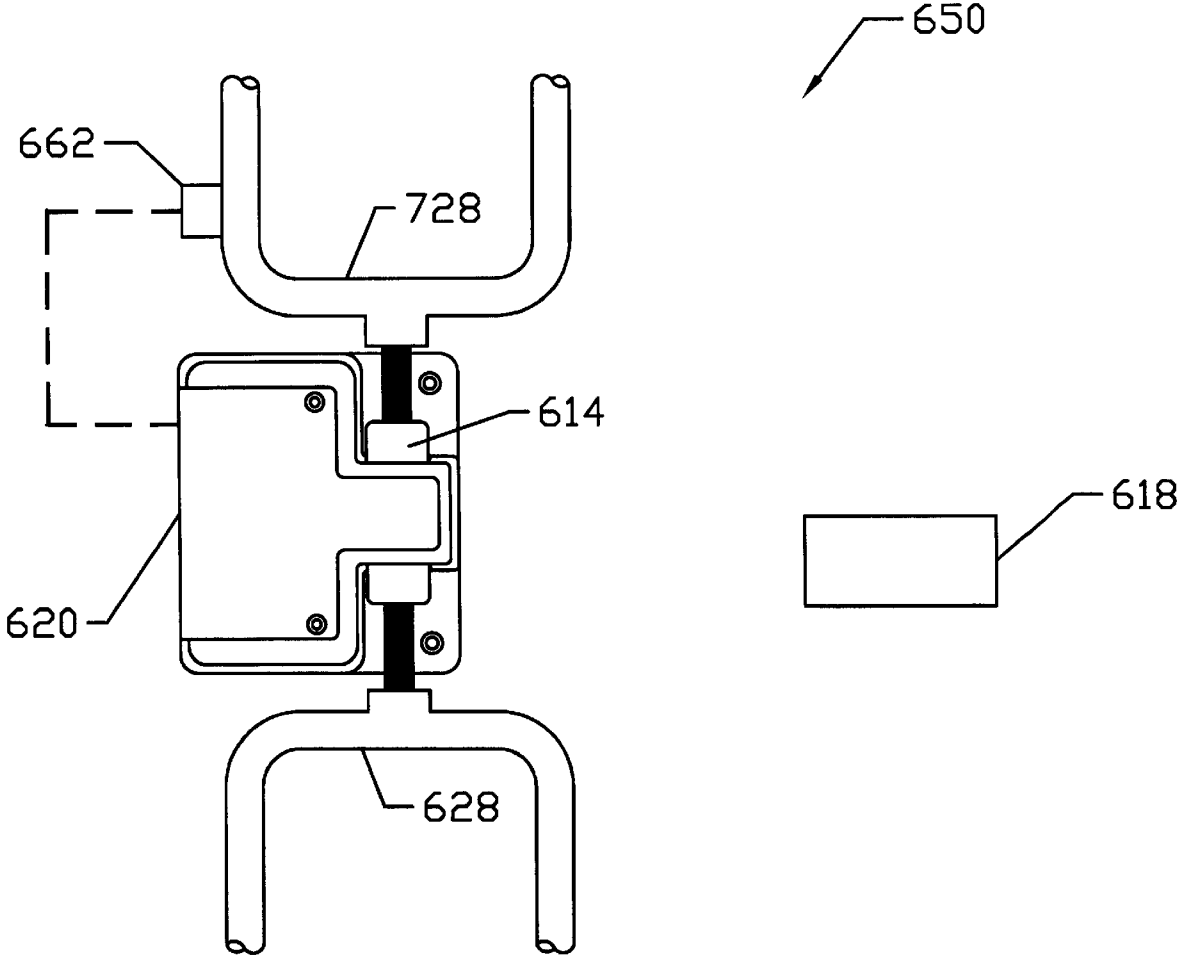
FIG. 13—is a front elevation view of kit of parts in accordance with another preferred embodiment of the present invention, for retrofit to an existing double-valve faucet.
Figure 14:
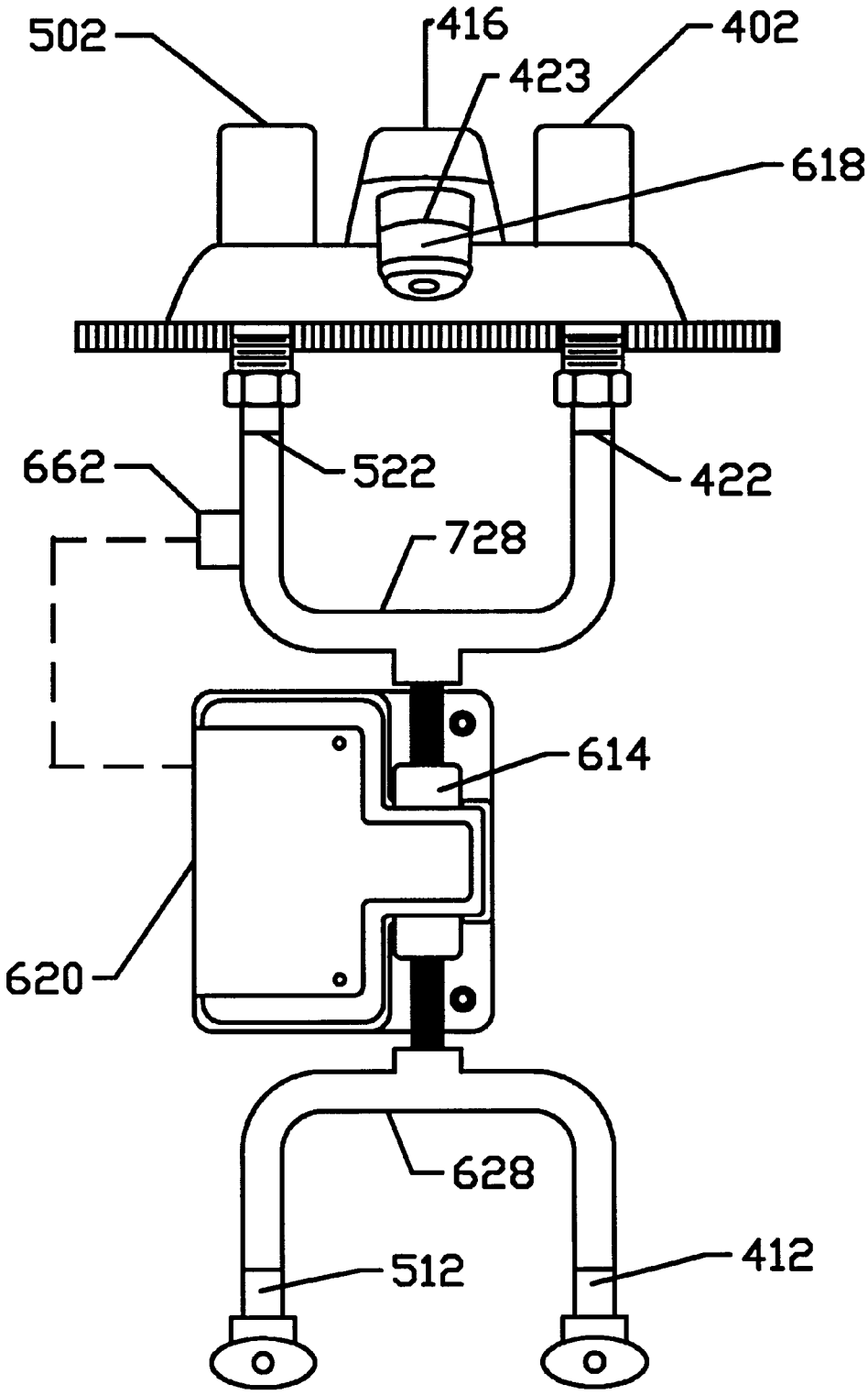
FIG. 14—is a front elevation view of a double-valve faucet with the kit of parts of FIG. 13.
Figure 14A:
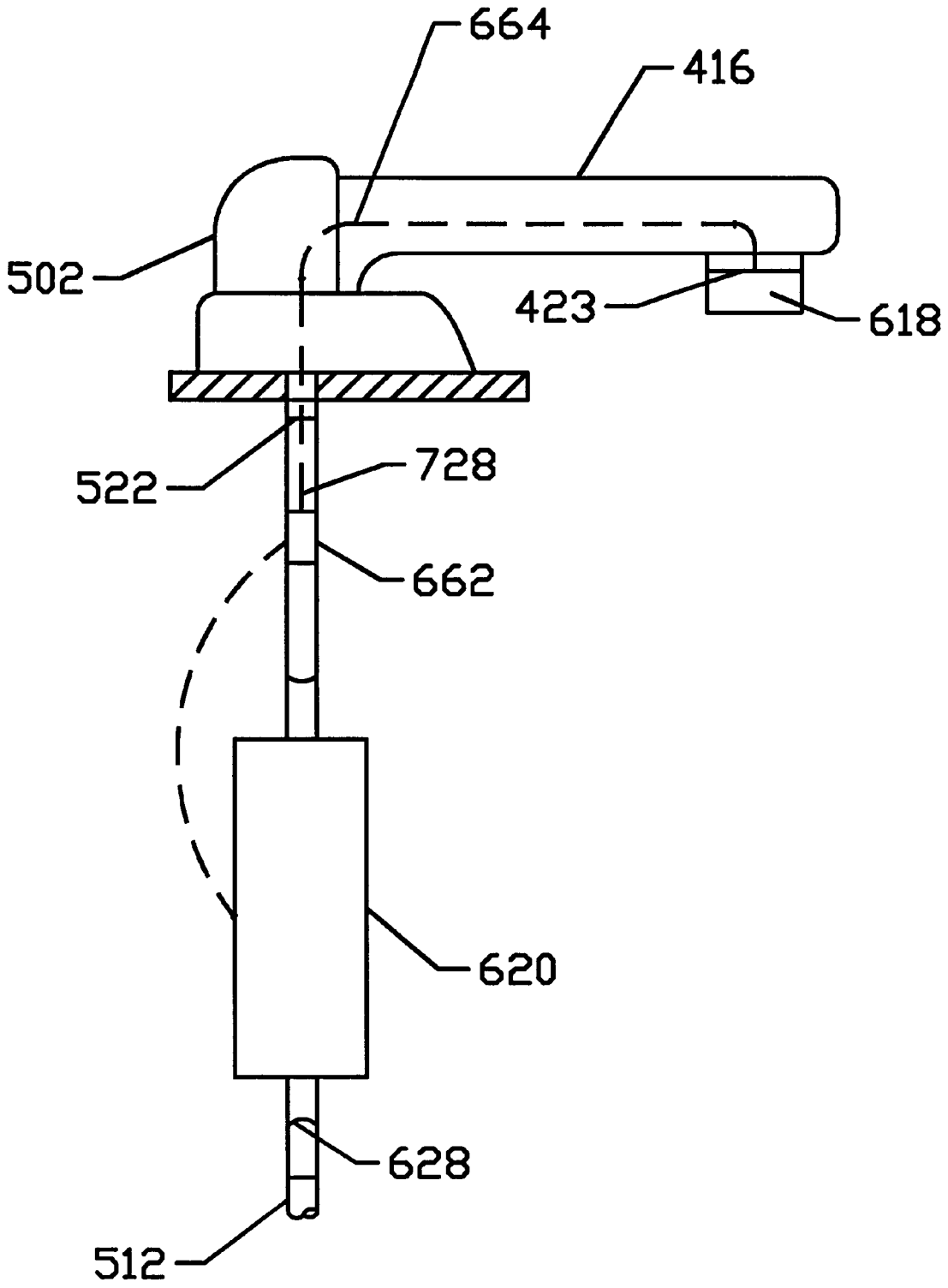
FIG. 14*a*—is a side elevation view of a the faucet shown in FIG. 14.

Another alternative embodiment of the present invention, as shown in FIGS. 13, 14 and 14*a*, is another kit of parts 650 for retrofit to double-valve faucet 400 as shown in FIG. 10. In this embodiment, double-valve faucet 400 is converted such that both hand actuators 402 and 502 cause fluid of the same temperature to dispense. As shown in FIG. 13, the kit of parts 650 includes a control valve 614 which is similar to control valves 314 and 14, an adaptor 618, a valve controller 620, an upstream tee 628, and a downstream tee 728. FIGS. 14 and 14*a* show the kit of parts 650 installed on faucet 400. Downstream tee 728 connects to inlet ends 422 and 522 of outlet conduit 416. Downstream tee 728 is made from a conductive material, such as, brass, copper, stainless steel, alloy steel, or chrome plated plastic. Downstream tee 728 must be connected such that it is in electrical communication with outlet end 423 of outlet conduit 416. Attached to the upstream end of downstream tee 728 is control valve 614. A valve controller receiver 662 is included in kit of parts 650, and may be mounted directly to downstream tee 728, such that it is in electrical communication with outlet conduit 416. Receiver 462 may, however, be located in any way such that it is in electrical communication with outlet conduit 416. Upstream tee 628 connects to control valve 614, and supply conduits 412 and 512 connect to upstream tee 628.

In order to prevent fluid from flowing from supply conduit 412, through upstream tee 628, and into supply conduit 512 (or in the reverse path, from conduit 512, through tee 628, and into conduit 412) due to a pressure differential in conduits 412 and 512, check valves are located within upstream tee 628, just downstream of the upstream ends of upstream tee 628. These check valves permit flow into upstream tee from either supply conduit 412 or 512, but only permit fluid to discharge from the downstream end of tee 628.

Adaptor 618 is similar to adaptors 318 and 18 except that adaptor 618 is adapted for mounting to outlet end 423 of existing outlet conduit 416. Similar to the embodiments described above, the outlet end 423 of outlet conduit 416 may be threaded and adaptor 618 may be threaded with a matching thread, and adaptor 618 is threaded onto the outlet end 423 of outlet conduit 416, thereby connecting outlet conduit 416 with adaptor 618. However, adaptor 618 may be mounted in any way such that an adaptor transmitter similar to transmitter 40, is in electrical communication with outlet conduit 416 and such that sensors, similar to sensors 32, are located to sense the desired fluid properties.

An electrical signal path 664, through which signals 663 (not shown) are sent between adaptor 618 and valve controller receiver 662, is shown schematically in FIG. 14*a*.

A user-override switch 844 may further be included on the adaptor input modules 36, 136 for any of the adaptors described above, as shown in FIGS. 2 and 5. User-override switch 844 prevents the control valves from being closed in the event of a fluid property exceeding a specified value. This may be accomplished at the adaptor processor so that the adaptor processor only sends signals to the valve controller if user override switch 844 is off. Alternately, user-override switch 844 may open a circuit, preventing sensor data signals from reaching the adaptor processor from the sensors.

Each of the adaptors disclosed above may further include a user-detector sensor 848, as shown in FIGS. 2 and 5. User-detector sensor 848, upon detection of a user, sends a signal to the adaptor processor. Upon receipt of the signal indicating that a user is present, the adaptor sends a signal to the valve controller. In a lavatory, for example, the detection of a user will trigger the system to open the control valves, and when the user is no longer detected, the system will close the control valves. In a urinal or a toilet, however, the presence of a user will trigger the system to wait until the user is no longer detected, and then, when the user is no longer detected (ie. the user has moved away from the urinal or toilet), to open the control valve for a set 'flushing cycle' period of time.

As well, systems equipped with user-detector sensor 848, can operate such that the adaptor only sends signals to the valve controller when a user is present. In this way, battery power in the adaptor is conserved, since the power consumed in operating user-detector sensor 848 continuously, is smaller than the power consumed in transmitting signals continuously between an adaptor and a valve controller.

User-detector sensor 848 may be any type known in the art, such as a proximity sensor, a mechanical switch, an ultrasonic emitter, an infra-red beam, or a passive infra-red detector.

A pressure sensor may be included as one of the plurality of sensors in the adaptor to provide an alternate way of conserving battery energy in the adaptor, instead of user-detector sensor 848. When the pressure sensor detects atmospheric pressure in the outlet conduit, indicating that there is no fluid flow in the outlet conduit, the adaptor is prevented from sending signals to the receiver. When a user initiates fluid flow by means of the input module on the adaptor or by means of a hand valve, and fluid flows through the outlet conduit, then the pressure sensor will sense a pressure increase from the fluid flow, indicating to the adaptor to send signals to the receiver.

Any of the above described adaptors may further include an output module 849, as shown in FIGS. 2 and 5. Output module 849 indicates fluid property data and may further indicate the status of certain elements of the system, such as 'user-detected', 'user-override ON', battery strength, system fault condition, specified fluid property limit values, and/or whether a fluid property has exceeded the specified safety limits. Output module 849 may be a visual display, such as an LCD or an LED device, and/or an audio device. Output module 849 may further include an alarm 851 which indicates to a user visually and/or audibly whether a fluid property has exceeded a specified limit.

Figure 15:
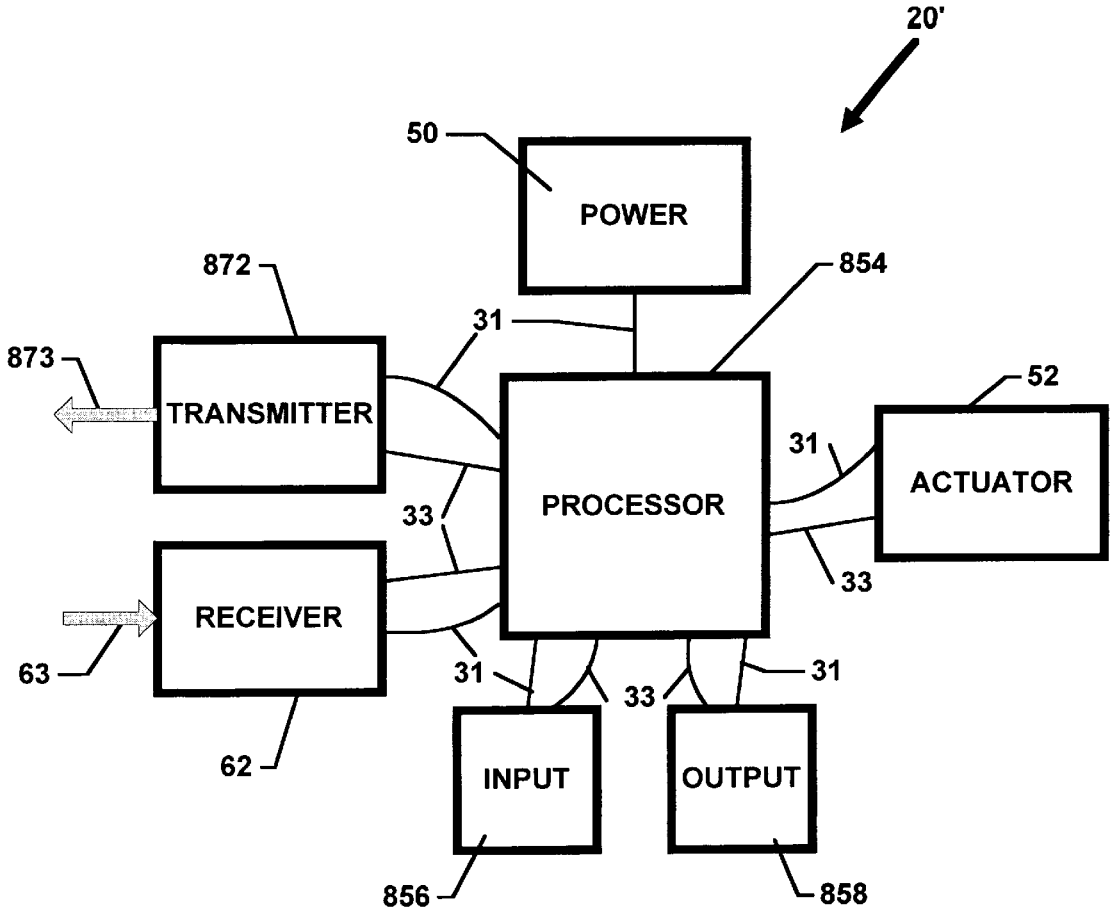
FIG. 15—is a block diagram of an alternative valve controller for use with a single-valve faucet in accordance with another preferred embodiment of the present invention.

Single-valve faucet 10, illustrated in FIG. 1, may alternately include a valve controller 20', shown in FIG. 15, instead of valve controller 20. Valve controller 20' is similar to valve controller 20, with the following differences. Valve controller 20' includes a valve controller processor 854 that can determine control valve actuation required, based on data received. Therefore, valve controller 20' is adapted to respond to signals 63 that correspond with fluid property data and other data obtained from sensors 32, 848, and user input from input module 36. In this embodiment, valve controller receiver 62 sends received signals 63 to valve controller processor 854 that processes the signals 63 and determines the appropriate control valve actuation required. Processor 854 controls control valve 14 through valve actuator 52. Valve controller 20' may also include a valve controller input module 856 and a valve controller output module 858. Input module 856 and output module 858 may operate similarly to input module 36 and output module 849 respectively. Similarly, valve controller 120 may further include input module 856 and output module 858.

Retrofit kit of parts 350 may include a valve controller modified in a manner similar to valve controller 20', instead of valve controller 320. Similarly, retrofit kit of parts 650 may include a valve controller modified in a manner similar to valve controller 20', instead of valve controller 620.

For any of the adaptors described above wherein the adaptor comprises only one sensor, the adaptor may not require an adaptor processor, adaptor input module 36 and adaptor output module 849. In this example, the lone sensor will transmit signals directly to the adaptor transmitter. The valve controller receiving the signals must therefore include a valve controller processor, similar to valve controller 20', 120, and 420 and a valve controller input module 856, and may include a valve controller output module 858, as shown FIGS. 6 and 15. In this case, the valve controller processor receives fluid property data from the adaptor and input data from the input module 856, and determines the appropriate valve actuation that is required. In all cases where the adaptor includes two or more sensors, however, the adaptor advantageously includes a processor to coordinate the sending of signals to the valve controller. In all cases where an adaptor sends more than one signal to the valve controller, both the valve controller and the adaptor require a processor. This may comprise fluid property data signals from two or more sensors, or alternately, this may comprise valve commands for two or more valves.

Each of the valve controllers that include a valve controller processor may further include a valve controller transmitter 872, and each of the adaptors disclosed above may further include an adaptor receiver 870. The valve controller, in response to receiving a signal from the adaptor, may transmit an acknowledgement signal 873 back to adaptor receiver 870 acknowledging receipt of the original signal. Upon sending a signal 63, and waiting for a specified period of time, the adaptor can flag a fault condition if it does not receive an acknowledgement signal 873 back from the valve controller. Upon determining that a fault condition exists, indication may be made in output module 849, alarm 851 may be signalled, and the valve controller may instruct one or more control valves to close or to change position.

If both the adaptor and the receiver of a faucet or kit of parts in accordance with the present invention, possess a processor, then signals sent between the adaptor and receiver may be digital or analog signals. If either the adaptor or the receiver does not include a processor, then the signals must be analog signals.

Figure 16:
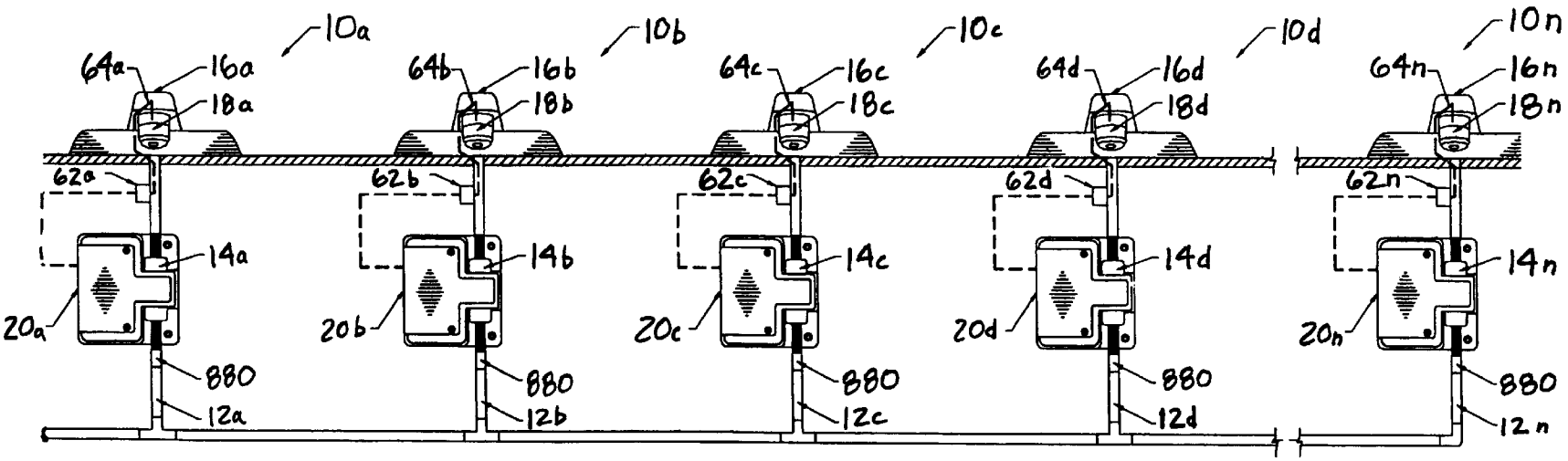
FIG. 16—is a front elevation view of a grouping of faucets according to an alternate embodiment of the present invention.

FIG. 16 depicts various faucets grouped, for example in a restaurant washroom. Faucet 10*a* includes adaptor 18*a*, which includes transmitter 40*a* (not shown), and which sends signals 63*a* (not shown) along electrical signal path 64*a* to receiver 62*a*. Similarly, faucet 10*b* includes adaptor 18*b*, which includes transmitter 40*b* (not shown), and which sends signals 63*b* along electrical signal path 64*b* to receiver 62*b*, and so on. In this scenario, signals 63*a* sent from adaptor 18*a* on faucet 10*a* will be received by receivers 62*a*, and there is a risk that these signals may also be received by receivers 62*b*, 62*c*, 62*d* . . . 62*n* on other faucets that happen to be in electrical communication with transmitter 40*a*, through supporting structures, countertops, or piping for example, a phenomenon known as cross-talk. In order to prevent cross-talk, (ie. receivers 62*b*–62*n* from receiving the signals 63*a* from transmitter 40*a*), an isolator 880 may be installed to electrically isolate electrical signal path 64*a*. Isolator 880 must be installed at some point outside of electrical signal path 64*a*. Isolator 880 is made from a non-conductive, liquid-impermeable material, such as rubber. In the embodiment shown in FIG. 16, isolator 880 is shown in the form of a spool piece of conduit between control valves 14*a*–14*n* and supply conduits 12*a*–12*n*. Alternately, isolator 880 may be in the form of a washer that separates control valve 14*a*–*n* from outlet conduit 16*a*–*n*.

In the example shown in FIG. 16, the faucets shown are single-valve faucets, functionally similar to those in the embodiment of FIG. 1, however, isolator 880 may be used to prevent cross-talk in groupings of any of the different faucets described above. In some instances, two or more isolators 880 may be required in order to isolate the electrical signal path between adaptor and receiver, for example, for two valve faucets.

In the case where the structure surrounding a faucet according to an embodiment of the present invention, is composed of an electrically conductive material, and the surrounding structure is in electrical communication with the above described electrical signal paths, an isolator layer can be installed to isolate the above described electrical signal paths.

As an alternate way of preventing the reception and action based on neighbouring or other stray signals travelling along the electrical path, any of the transmitters described in the embodiments above may add identification codes to signals sent out, such that signals sent between the transmitters and receivers include the identification code. Each individual transmitter produced can be provided with a code that is unique. The code is used to indicate to the receiver the source of the signal received. In this way, the processor that is processing the received signal is adapted to only act upon signals that include the expected identification code, so that stray signals received, are ignored. Alternately, each individual transmitter/receiver pair may be produced so that they operate on a specific frequency. Therefore, the receiver is adapted to only pass on signals sent at the appropriate frequency.

Means, as described above, of isolating signal paths, or of adding identification codes to signals or frequency encoding signals are not required, if electrical signal paths 64*a–n* are isolated inherently by the components of faucet 10*a–n*, or if For example, supply conduits 12*a–n*, may be made from a non-conductive material, and will therefore inherently isolate electrical signal path 64*a–n*.

In all of the kits of parts described above, valve conduits may not be required, if the control valves and isolators (if the isolators are required) that are included in the kits can be directly connected to the outlet conduits of the existing faucets.

Utilizing an outlet conduit as an electrical conduit between a transmitter and a receiver provides an inexpensive, aesthetically appealing, robust, power saving, long-range, interference-free means of communicating signals. Also, the system avoids the use of sophisticated and expensive wireless means and unsightly, dangerous wired means. Furthermore, the system can be readily adapted or retro-fitted onto existing faucets simply and easily or may be pre-installed onto a faucet at the factory.

As will be apparent to persons skilled in the art, various modifications and adaptations of the structures described above are possible without departure from the present invention, the scope of which is defined in the appended claims.

I claim:

1. A faucet comprising:

an electrically conductive fluid outlet conduit;

a transmitter for transmitting electrical signals, said transmitter connected electrically with said electrically conductive fluid outlet conduit;

at least one control valve for controlling the flow of fluid through said electrically conductive fluid outlet conduit; and a valve controller for changing the position of said at least one control valve, said valve controller including an electrical signal receiver, said electrical signal receiver being connected electrically with said electrically conductive fluid outlet conduit, said valve controller being adapted for receiving said electrical signals, and wherein said electrical signals are communicated through said electrically conductive fluid outlet conduit.

2. A faucet as in claim 1, wherein said electrical signals are communicated along an electrical signal path, and said faucet further comprises an isolator for electrically isolating said electrical signal path.

3. A faucet as claimed in claim 1, wherein said electrical signals are digital signals.

4. A faucet as claimed in claim 3, wherein said electrical signals include a specific digital identification code said electrical signal receiver is adapted to act upon only electrical signals that include said specific digital identification code.

5. A faucet as claimed in claim 1, wherein said electrical signals are analog signals.

6. A faucet as claimed in claim 5, wherein said transmitter is adapted to send electrical signals at a specific electrical frequency to said electrical signal receiver, and said electrical signal receiver is adapted to respond only to electrical signals at said frequency.

7. A faucet as claimed in claim 1, further comprising a switch for activating said transmitter and a user detector for operating said switch upon detection of a user.

8. A faucet as claimed in claim 1, wherein said transmitter is a component part of an adaptor, and said adaptor further comprises a sensor and said sensor is adapted to sense at least one selected fluid property of fluid flowing in said electrically conductive fluid outlet conduit.

9. A faucet as claimed in claim 8, wherein said adaptor further comprises an output device for indicating the status of said at least one selected fluid property.

10. A faucet as claimed in claim 8, wherein said adaptor further comprises an alarm for indicating that said at least one selected fluid property exceeds a specified limit.

11. A faucet as claimed in claim 9, wherein said adaptor further comprises an alarm for indicating that said at least one selected fluid property exceeds a specified limit.

12. A faucet as claimed in claim 8, wherein said valve controller further comprises an output device for indicating the status of said at least one selected fluid property.

13. A faucet as claimed in claim 8, wherein said valve controller further comprises an alarm for indicating that said at least one fluid property exceeds a specified limit.

14. A faucet as claimed in claim 12, wherein said valve controller further comprises an alarm for indicating that said at least one selected fluid property exceeds a specified limit.

15. A faucet as claimed in claim 8, wherein said transmitter generates at least one electrical signal selected form the group of electrical signals consisting of:

"Close control valve", "Open control valve", "Open control valve by a predetermined amount", "Close control valve by a predetermined amount", and a fluid property.

16. A faucet as claimed in claim 8, wherein said adaptor further comprises an adaptor electrical signal receiver and said valve controller further comprises a valve controller transmitter for generating an electrical acknowledgement signal, and said valve controller transmitter is adapted to send said electrical acknowledgement signal to said adaptor electrical signal receiver through said electrically conductive fluid outlet conduit.

17. A faucet claimed as in claim 1, wherein said faucet comprises two control valves.

18. A kit of parts for use with a faucet with an electrically conductive fluid outlet conduit, said kit of parts comprising:

an adaptor, said adaptor comprising at least one sensor, said sensor being adapted to sense at least one selected fluid property of fluid flowing in said electrically conductive fluid outlet conduit, and an adaptor transmitter, said adaptor transmitter connected electrically with said electrically conductive fluid outlet conduit, said adaptor being adapted to send electrical signals through said electrically conductive fluid outlet conduit;

at least one control valve for controlling the flow of fluid through said electrically conductive fluid outlet conduit; and a valve controller for changing the position of said at least one control valve, said valve controller further comprising an electrical signal receiver for receiving electrical signals through said electrically conductive fluid conduit, said electrical signal receiver connected electrically with said electrically conductive fluid outlet conduit.

19. A kit of parts as claimed in claim 18, further comprising an isolator for electrically isolating said electrical signals.

20. A kit of parts as claimed in claim 18, wherein said electrical signals are digital signals.

21. A kit of parts as claimed in claim 20, wherein said electrical signals includes a specific digital identification code and said electrical signal receiver is adapted to act upon only electrical signals that include said specific digital identification code.

22. A kit of parts as claimed in claim 18, wherein said electrical signals are analog signals.

23. A faucet as claimed in claim 22, wherein said transmitter is adapted to send electrical signals at a specific electrical frequency to said electrical signal receiver, and said electrical signal receiver is adapted to respond only to electrical signals at said frequency.

24. A kit of parts as claimed in claim 18, further comprising a switch for activating said transmitter and a user detector for operating said switch upon detection of a user.

25. A kit of parts as claimed in claim 18, wherein said adaptor further comprises an output device for indicating the status of said at least one selected fluid property.

26. A kit of parts as claimed in claim 18, wherein said adaptor further comprises an alarm for indicating that said at least one fluid property exceeds a specified limit.

27. A kit of parts as claimed in claim 26, wherein said adaptor further comprises an alarm for indicating that said at least one selected fluid property exceeds a specified limit.

28. A kit of parts as claimed in claim 18, wherein said valve controller further comprises an output device for indicating the status of said at least one selected fluid property.

29. A kit of parts as claimed in claim 18, wherein said valve controller further comprises an alarm for indicating that said at least one fluid property exceeds a specified limit.

30. A kit of parts as claimed in claim 28, wherein said valve controller further comprises an alarm for indicating that said at least one selected fluid property exceeds a specified limit.

31. A kit of parts as claimed in claim 18, wherein said adaptor further comprises an adaptor electrical signal receiver and said valve controller further comprises a valve controller transmitter for generating an electrical acknowledgement signal, and said valve controller transmitter is adapted to send said electrical acknowledgement signal to said adaptor electrical signal receiver through said electrically conductive fluid outlet conduit.

32. A kit of parts as claimed in claim 18, wherein said transmitter generates at least one electrical signal selected form the group of electrical signals consisting of:

"Close control valve", "Open control valve", "Open control valve by a predetermined amount", "Close control valve by a predetermined amount", and a fluid property.

33. A kit of parts as claimed in claim 18, wherein said kit of parts comprises two control valves.

34. A faucet comprising:

a fluid outlet conduit;

a transmitter for transmitting electrical signals;

at least one control valve for controlling the flow of fluid through said fluid outlet conduit; and a valve controller for changing the position of said at least one control valve, said valve controller including an electrical signal receiver, said valve controller being adapted for receiving said electrical signals, wherein said fluid outlet conduit is electrically conductive, said transmitter is connected electrically with said electrically conductive fluid outlet conduit, said electrical signal receiver is connected electrically with said electrically conductive fluid outlet conduit, and said electrically conductive fluid outlet conduit is the electrical path for conducting said electrical signals from said transmitter to said receiver.

35. A kit of parts for use with a faucet with an electrically conductive fluid outlet conduit, said kit of parts comprising:

an adaptor, said adaptor comprising at least one sensor, said sensor being adapted to sense at least one selected fluid property of fluid flowing in said electrically conductive fluid outlet conduit, and an adaptor transmitter, said adaptor transmitter being adapted to send electrical signals;

at least one control valve for controlling the flow of fluid through said electrically conductive fluid outlet conduit; and a valve controller for changing the position of said at least one control valve, said valve controller further comprising an electrical signal receiver for receiving electrical signals, wherein said adaptor transmitter is connected electrically with said electrically conductive fluid outlet conduit, said electrical signal receiver is connected electrically with said electrically conductive fluid outlet conduit, and said electrically conductive fluid outlet is the electrical path for conducting said electrical signals from said adaptor transmitter to said electrical signal receiver.

* * * * *

UNITED STATES PATENT AND TRADEMARK OFFICE

CERTIFICATE OF CORRECTION

PATENT NO. : 6,340,032 B1
DATED : January 22, 2002
INVENTOR(S) : Zosimadis

It is certified that error appears in the above-identified patent and that said Letters Patent is hereby corrected as shown below:

Column 12,
Line 30, the word "form" has been changed to -- from --, so that the sentence reads "wherein said transmitter generates at least one electrical signal from the group of electrical signals consisting of";

Column 13,
Line 10, the word "faucet" has been changed to -- kit of parts --, so that the sentence reads "A kit of parts as claimed in claim 22"; and
Line 48, the word "form" has been changed to -- from --, so that the sentence reads "wherein said transmitter generates at least one signal selected from the group of electrical signals consisting of".

Signed and Sealed this

Twenty-third Day of April, 2002

*Attest:*

*Attesting Officer*

JAMES E. ROGAN
*Director of the United States Patent and Trademark Office*